United States Patent [19]

Eads et al.

[11] 4,199,016

[45] Apr. 22, 1980

[54] AXE CONSTRUCTION

[75] Inventors: Harold O. Eads, Parkersburg, W. Va.; James W. Robison, Belpre, Ohio

[73] Assignee: McDonough Co., Parkersburg, W. Va.

[21] Appl. No.: 897,165

[22] Filed: Apr. 17, 1978

[51] Int. Cl.[2] ..... B26B 23/00

[52] U.S. Cl. ..... 145/2 R

[58] Field of Search ..... 145/2 R, 2 A, 3

[56] References Cited

U.S. PATENT DOCUMENTS

| | | | |
|---|---|---|---|
| 618,658 | 1/1899 | Garlick et al. | 145/2 R |
| 712,942 | 11/1902 | Lawton | 145/2 R |
| 1,496,250 | 6/1924 | Van Slett | 145/2 R |

FOREIGN PATENT DOCUMENTS

| | | | |
|---|---|---|---|
| 653050 | 11/1962 | Canada | 145/2 R |

*Primary Examiner*—Othell M. Simpson

*Assistant Examiner*—J. T. Zatarga

*Attorney, Agent, or Firm*—Cushman, Darby & Cushman

[57] ABSTRACT

An axe comprising a blade formed of flat plate stock of generally uniform thickness, and a U-shaped handle attaching strap formed of flat plate stock of generally uniform thickness, the strap is fixedly mounted on a handle end portion with the bight portion and leg portions thereof substantially circumferentially surrounding the handle end portion and free end portions thereof extending therefrom in generally parallel relation beyond a leading edge of the handle end portion. The blade is rigidly mounted with its attaching portion disposed between the free end portions of the attaching strap and a trailing edge thereof facing the leading edge of the handle portion. The cutting edge of the blade is of uniform wedge-shaped cross-sectional configuration throughout its extent, the wedge shape being formed by generally straight bevel surfaces.

9 Claims, 4 Drawing Figures

AXE CONSTRUCTION

This invention relates to the construction of axes and more particularly to improvements in a single edge axe construction.

Axes have been manufactured by forging procedures for many, many years and, as far as applicant is aware, all commercially available axes have been manufactured utilizing forging techniques. Since forging techniques require the heating of metal to temperatures of 2,000° F. and above, there is necessarily required the expenditure of considerable energy simply to provide the required heat. The increase in costs relating to fuels used in heating occasioned by the recent energy crisis has been reflected in an increase in the cost of forged tools to a considerable extent. These increased costs have made it evident that it would be of considerable economic advantage to eliminate the forging procedures in the manufacture of axes if it were possible to otherwise produce an axe having as good or better cutting characteristics.

The costs involved in conventional forging procedures can be appreciated when it is understood that the following procedures are conventionally carried out in manufacturing conventional axe heads. The metal blank is first heated by electrical field induction, electrical resistance, gas, or some other combustible fuel. The blank is allowed to stay in the furnace until it is red hot or at a temperature above 2,000° F., sometimes near 2,200° F. The operator then removes a red hot blank from the furnace with tongs and places it in a preformed die cavity within a blocker hammer or press. The usual situation is for the blocker hammer or press to have cooperating dies provided with three stations, one of which is a pre-form station, the second of which is a roughing station, and the third of which is a finishing station. The red hot blank which is placed in the preform cavity usually receives one blow and it is then transferred by the user through the use of tongs into the second cavity, where the press is allowed to impart two blows to the metal so that it ends up in the general shape of an axe head. Next, the metal is transferred by the tongs into the third die cavity where two blows are applied, resulting in the formation of the metal into an axe head having flashing extending therefrom in a position corresponding to the parting line of the die cavity.

Next, the metal in the shape of an axe head with flashing is moved by tongs to a trim die where, in one blow, the flashing is removed. At the end of this stage the metal has the shape of an axe head without flashing, but there is no hole in the axe head to receive the handle. The hole is formed in an upsetter machine. However, prior to the movement of the metal into the upsetter machine, it is necessary to re-heat the same up to the red hot condition of approximately 2,000° F. or thereabove. This re-heating is usually done on a batch basis in another furnace, different from the one used to initially heat the blanks. The upsetter machine serves to stamp out the handle hole in the heated axe head metal. However, the temperature at which the stamped out hole is formed can have a great deal of effect on the dimension of the hole formed in the axe head once it is cooled. For this reason, conventional practice makes it difficult to control the tolerances to less than ⅛". Moreover, the hole punching operation usually establishes burrs which must be removed. Consequently, the next operation after the upsetter machine operation serves to form the handle hole in the head is the grinding off of any burrs which are formed.

After that, the axe head is subjected to a grit blasting procedure which serves to knock off scale and otherwise provide a smoother exterior surface. Next, the cutting edge of the axe head is heat treated in lead pots to achieve a 60 Rockwell C hardness. A final heat treatment is performed in a draw furnace to bring the cutting edge of the metal to a 52 Rockwell C hardness. Following the final heat treatment, a final grit blasting operation is performed, after which there is a finishing grinding and polishing procedure applied.

Accordingly, it is an object of the present invention to provide an axe construction which can be manufactured in such a way as to eliminate the conventional forging operations and still produce an axe which compares favorably in terms of performance with a forged axe. In accordance with the principles of the present invention, this objective is obtained by providing an axe construction which includes a blade formed of flat plate stock of generally uniform thickness and a separate handle attaching strap formed of flat plate stock of generally uniform thickness. The blade includes a generally rectangularly shaped handle attaching portion having a trailing edge facing in one direction and side edges extending from the trailing edge in a generally opposed direction and a cutting portion having side edges extending from the side edges of the attaching portion and a sharpened cutting edge facing in the aforesaid generally opposed direction extending between the side edges. The handle attaching strap is bent into a generally U-shaped configuration so as to provide a flat bight portion and a pair of leg portions converging with respect to one another from the bight portion and terminating in free end portions disposed in generally parallel relation with respect to one another. The strap is mounted on a handle end portion with the bight portion and leg portions thereof substantially circumferentially surrounding the handle end portion and the free end portions thereof extending in the aforesaid generally parallel relation beyond a leading edge of the handle end portion. The blade is mounted with its attaching portion disposed between the free end portions of the attaching strap and the trailing edge thereof facing the leading edge of the handle end portion. Means is provided for effecting a rigid securement of the free end portions of the strap and the attaching portion of the blade disposed therebetween and for effecting the fixed securement of the blade and strap in mounted relation on the handle end portion.

By following the principles of the present invention it is possible to reduce the sixteen basic operations heretofore performed in producing a forged axe head to ten operations. The attendant labor costs can be reduced as much as 75%. While the present construction is provided with heat treatment in a manner similar to the forged construction, the energy costs involved in bringing the original blank up to red hot heat of 2,000° F. and above and to re-heat the de-flashed axe head prior to the upsetter machine operation is reduced by entirely eliminating both of these procedures. Moreover, it is important to note that the heat treatment procedures herein applied are limited in their application to the blade (as distinguished from the total metal making up the head, as is the case in a forged procedure), and hence the heat treatment on a per pound basis can be more economically applied.

It is recognized that other hand tools, such as brush cutters, have been manufactured utilizing a blade secured to a handle by straps, see for example, Reeves U.S. Pat. No. 1,030,429. Such tools, however, are essentially different from axe constructions and are not provided to perform the same cutting functions as an axe. It is of significance to note, however, that while the present invention provides for the elimination of forging procedures by the adoption of a composite blade and strap construction, the resulting axe can have equal or superior cutting characteristics to axes manufactured in accordance with conventional forging procedures. Such cutting equality or superiority is accomplished by insuring that the construction embodies a preferred optimum weight distribution characteristic which differs from the weight distribution characteristic normally provided in forged axes and a particular cutting edge construction which heretofore has not been customarily provided in forged axe heads.

An optimum weight distribution and more efficient and uniform cutting edge can be obtained with the present construction, primarily because it is possible to hold tolerances to 0.006 inches in accordance with the principles of the present invention, whereas the usual tolerance held in forged procedures is more nearly 0.125 inches. It will be understood that when dealing with plate stock of uniform thickness, a cutting edge can be formed in mechanical grinding machines which are of uniform straight bevel (e.g. approximately 24° included angle). The very favorable cutting ability of axes constructed in accordance with the present invention would indicate that the cutting edge and weight distribution have a greater bearing on cutting efficiency than any other two aspects of the axe construction. In terms of weight distribution, it has been found to be desirable to concentrate as much of the total head weight provided as is possible between the cutting edge and the handle. In the present construction the total weight of the blade is concentrated between the cutting edge and handle. Only the weight of the strap, which is preferably of thinner stock than the blade, is distributed rearwardly of the trailing edge of the blade. It is also evident that cutting efficiency is greatly affected by the cross-sectional shape of the cutting edge and specifically the wedge angle and whether the wedge is straight, convex or concave, although it is equally apparent that as the concavity or convexity of the bevel approaches straightness the cutting effect is nearly the same. The important consideration is that with the present construction a desirable edge configuration can be reproduced on a uniform basis within the tolerances of much lower dimensions than those heretofore usually encountered in a forged axe head construction.

These and other objects of the present invention will become more apparent during the course of the following detailed description and appended claims.

The invention may best be understood with reference to the accompanying drawings, wherein an illustrative embodiment is shown.

Figure 1:
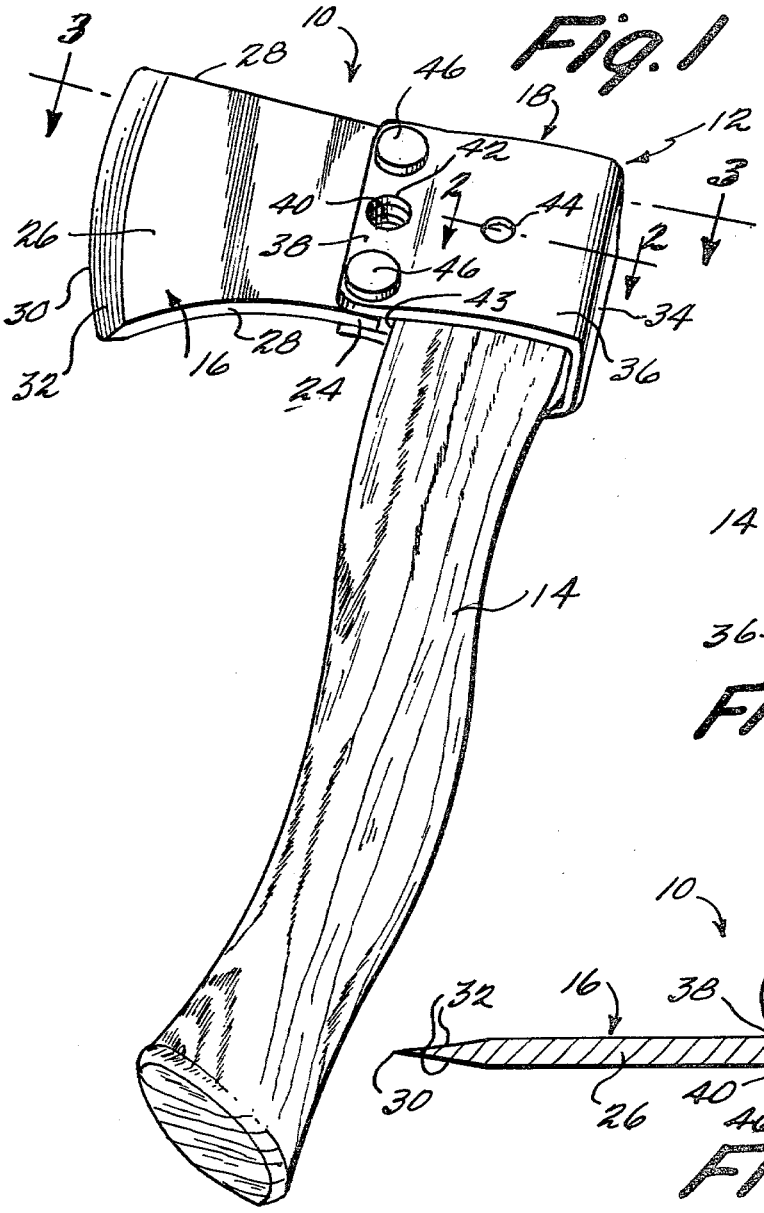
FIG. 1 is a perspective view of a short handled axe constructed in accordance with the principles of the present invention.
Figure 2:
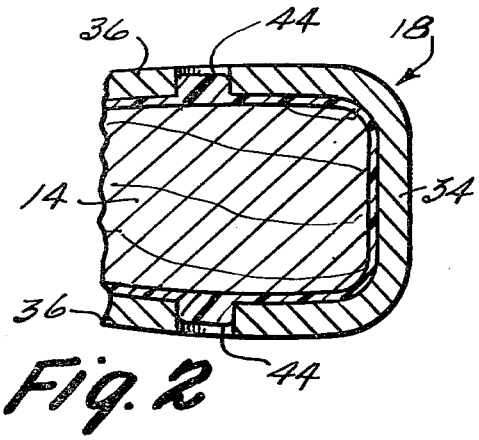
FIG. 2 is an enlarged fragmentary sectional view taken along the line 2—2 of FIG. 1.
Figure 3:
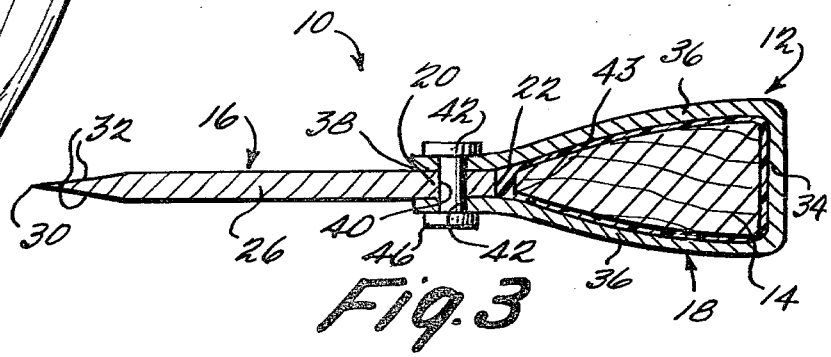
FIG. 3 is an enlarged fragmentary sectional view taken along the line 3—3 of FIG. 1.

Referring now more particularly to the drawings, there is shown in FIGS. 1–3 an axe construction, generally indicated at 10, embodying the principles of the present invention. The axe construction 10 includes an axe head assembly, generally indicated at 12, which is constructed in accordance with the principles of the present invention and a handle 14 on which one end portion of the axe head assembly 12 is mounted. The axe head assembly 12 includes a blade 16 formed of flat plate stock of generally uniform thickness. The stock material is preferably hot rolled steel. The axe head assembly 12 also includes a handle attaching strap, generally indicated at 18, which also is formed of flat plate stock of generally uniform thickness. A preferred material is cold rolled steel.

It will be noted that the blade 16 includes a generally rectangularly shaped handle attaching portion 20 having a trailing edge 22 facing in one direction and side edges 24 extending from the trailing edge 22 in a generally opposed direction. Extending integrally from the handle attaching portion of the blade is a cutting portion 26. The cutting portion has side edges 28 extending from the side edges 24 of the attaching portion and a sharpened cutting edge 30 facing in the generally opposed direction of extent of the side edges from the trailing edge 22. The cutting edge 30 is preferably convex, as shown, and extends between the side edges 28 which preferably diverge with respect to one another, as shown in their direction of extent from the trailing edge 22. The cutting edge 30 is formed by grinding the flat plate stock from which the blade is made in a mechanical grinding machine so as to provide generally straight beveled faces 32 of uniform wedge-shaped cross-sectional configuration throughout the extent of the cutting edge between the side edges 28. The generally straight beveled surfaces define an included angle therebetween which is approximately 24°. The angle may vary within an operative range of from 22° to 27°, a preferred range being 22°56′ to 26°7′ and a preferred embodiment being 24°26′.

The handle attaching strap 18 is bent into a generally U-shaped configuration to provide a flat bight portion 34 and a pair of leg portions 36 converging with respect to one another from the bight portion and terminating in generally rectangularly shaped free end portions 38 disposed generally in parallel relation with respect to one another. In the final axe construction 10, blade 16 and handle attaching strap 18 are rigidly secured together with the free end portions 38 of the strap 18 in rigid engagement with the attaching portion 20 of the blade 16 disposed therebetween. It is within the contemplation of the present invention to effect this rigid securement by any well-known means such as mechanical fasteners, welding or the like. It is also within the contemplation of the present invention to effect a fixed securement of the rigidly secured together blade and strap to the axe head receiving end portion of the handle 14 by any known means of securement such as the utilization of separate wedges or suitable adhesives, such as epoxy resin.

As shown, a combination of known fasteners and known adhesives is utilized to effect the securements involved in a manner similar to the known procedures utilized in connection with the manufacture of bush hooks of the type disclosed in the aforesaid patent. In the specific example illustrated in FIGS. 1–3, the attaching portion 20 of the blade 16 has formed therein a row of spaced apart openings 40. As shown, there are three such openings. Correspondingly positioned openings 42 are formed in the free end portions 38 of the handle attaching strap 18. It will be noted that the axe head assembly 12 is mounted on the handle end portion so that the bight portion 38 and leg portions 36 of the strap substantially circumferentially surround the handle end portion and the free end portions 38 thereof extend in generally parallel relation beyond a leading edge 43 of the handle end portion. The blade is mounted with its attaching portion 20 disposed between the free end portions 38 of the attaching strap and the trailing edge 22 thereof facing the leading edge 43 of the handle end portion.

With the preferred securing arrangement shown in FIGS. 1–3, the separate blade and strap are disposed in their mounted relation and the handle end with an application of epoxy resin to the peripheral surface thereof is disposed in mounted relation as aforesaid. Next, a bolt assembly is passed through the central registering openings 40 and 42 and tightened, which serves to bring the free end portions 38 of the strap into engaged relation with the attaching portion of the blade and to peripherally compress the strap in mounted relation around the handle end. This compressing of the periphery of the handle end portion will cause the exposy resin applied to the periphery thereof to flow into a pair of openings 44 formed in the central portion of the leg portions 32 of the strap. The flow of epoxy resin into the openings, as best shown in FIG. 2, performs two usual functions. First, the presence of the epoxy resin within the openings indicates to the operator that sufficient epoxy resin has been applied to effect the fixed securement desired; and second, the extension of the epoxy resin into the openings serves to key the fixed securement between the handle end portion and strap.

After the initial securement has been effected with the bolt assembly, conventional rivets 46 are engaged within the outer of the two registering openings 40 and 42. After the rivets 46 have been applied, the bolt assembly is removed, leaving the central opening free to function as a hang-up hole for the axe construction, as for example, to receive a peg from which the axe construction is suspended during storage.

Figure 4:
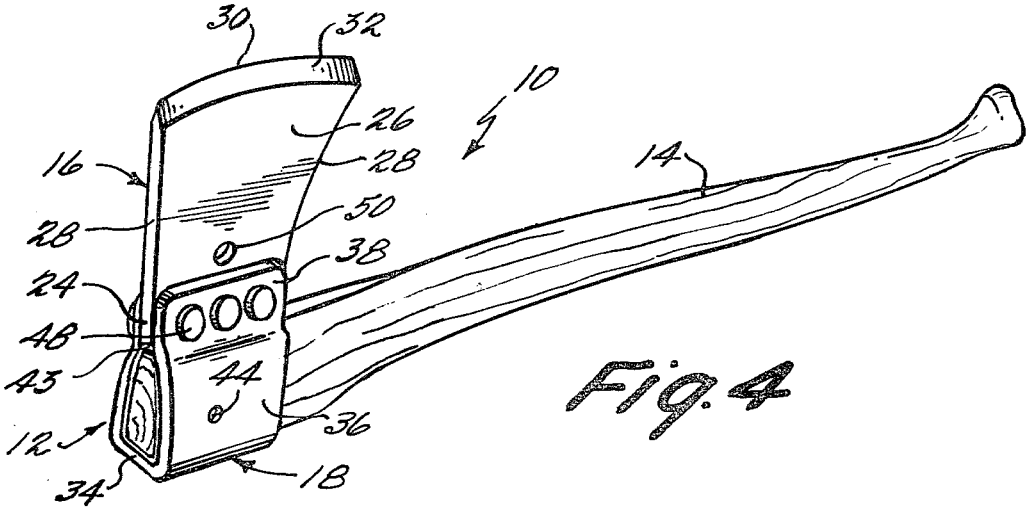
FIG. 4 is a perspective view of a long handled axe of modified construction embodying the principles of the present invention.

FIG. 4 illustrates a slight modification of the securing means described above with respect to FIGS. 1–3. In this embodiment the rigid securement of the strap free end portions 38 to the attaching portion 20 of the blade is effected by three rivets 48 and a separate hang-up hole 50 is formed in the cutting portion 26 of the blade, as shown.

It will be understood that the axe construction 10 of the present invention is capable of being manufactured utilizing conventional procedures and machines and without the utilization of forging equipment. This does not mean that all heating procedures are eliminated, as it is desirable to heat treat the blade 16, although heat treating of the strap 18 is not regarded as essential. In addition to eliminating conventional forging procedures, the axe construction 10 of the present invention is of significance in two further aspects. First, the arrangement is such that the total weight of the blade 12 is concentrated in front of the leading edge 43 of the handle after the axe head has been assembled on the handle, as shown. This weight concentration provides an effective cutting efficiency. Preferably this weight distribution is enhanced by making the thickness of the blade 16 greater than the thickness of the strap 18 which extends rearwardly of the blade. Exemplary thicknesses are 0.203" for the blade 16 and 0.125" for the strap 18. This weight distribution is further insured because of the lower dimensional tolerances which can be maintained with the present construction as compared with forged axe head constructions. To exemplify the effect of these tolerances, it will be noted that the thickness of the bight portion 34 when constructed in accordance with the exemplary embodiment above is 0.125". A bight portion thickness of 0.125" would not be practical with normal forging methods utilized in making forged axe heads.

Also of significant importance insofar as the cutting efficiency of the present axe construction 10 is concerned is the formation of the cutting edge 30 by the generally straight beveled surfaces 32. Here again, the ability to hold close tolerances as compared with forged constructions makes it possible to provide a generally straight beveled cutting edge construction which is uniform throughout its extent. Moreover, it is possible to maintain the angle defined between these generally straight beveled surfaces of the cutting edge construction within close tolerances to the most desirable angle. Thus, the aforesaid ranges and preferred 24° angle can be achieved on a repeatable basis by the utilization of automatic machinery. The cutting efficiency of the cutting edge does not require hand grinding or any particular skill or artisanship to achieve.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In an axe comprising a blade formed of flat plate stock of generally uniform thickness, said blade including a handle attaching portion having a trailing edge facing in one direction and side edges extending from said trailing edge in a generally opposed direction and a cutting portion having side edges extending from the side edges of said attaching portion and a sharpened cutting edge facing in said generally opposed direction extending between said side edges, the cutting edge of said blade being of uniform wedge-shaped cross-sectional configuration throughout its extent, the wedge shape being formed by generally straight bevel surfaces, a handle attaching structure of generally U-shaped configuration, said handle attaching structure including a bight portion and a pair of leg portions converging with respect to one another from said bight portion and terminating in free end portions disposed generally in parallel relation with respect to one another, said handle attaching structure comprising a strap formed of flat plate stock of generally uniform thickness less than the thickness of said blade, said strap being bent into said U-shaped configuration, an elongated handle including an axe head receiving end portion, said handle attaching structure being mounted on said handle end portion with the bight portion and leg portions thereof substantially circumferentially surrounding the handle end portion and the free end portions thereof extending in said generally parallel relation beyond a leading edge of said handle end portion, said blade being mounted with its attaching portion disposed between the free end portions of said handle attaching structure and the trailing edge thereof facing the leading edge of said handle end portion and mechanical fasteners rigidly securing said blade and said strap together in mounted relation on said handle end portion, the improvement which comprises an adhesive filling the annular spaced defined exteriorly by the trailing edge of said blade and the interior surfaces of the leg portions and bight portions of said strap and interiorly by the exterior periphery of said handle end portion, said adhesive being peripherally compressed in surrounding relation with the exterior periphery of said handle end portion when opposed forces are applied to said free end portions of said strap by said mechanical fasteners.

2. An axe as defined in claim 1 wherein said adhesive is epoxy resin.

3. An axe as defined in claim 1 wherein said generally straight bevel surfaces forming said cutting edge define an angle of approximately 24° therebetween.

4. An axe as defined in claim 1 wherein the side edges of the cutting portion of said blade diverge with respect to each other in a direction toward said cutting edge, said cutting edge being convexly curved between said side edges.

5. An axe as defined in claim 4 wherein said generally straight bevel surfaces forming said cutting edge define an angle of approximately 24° therebetween.

6. An axe as defined in claim 1 wherein the leg portions of said strap are formed with centrally located aligned openings therein within which adhesive flows during compression thereof as aforesaid.

7. An axe as defined in claim 6 wherein said mechanical fasteners include a pair of spaced rivets, the free end portions of said strap and the attaching portion of said blade having aligned openings formed therein between said rivets which serve (1) during assembly to receive a temporary bolt assembly therein and (2) after assembly to receive a peg on which the axe is suspended for storage.

8. An axe as defined in claim 6 wherein said cutting portion of said blade has an opening extending therethrough for receiving a peg on which the axe is suspended for storage.

9. An axe as defined in claim 1, 4, 5, 6, 7, 8, 2 or 3, wherein said bight portion is flat and disposed in a plane generally perpendicular to the plane of the blade.

* * * * *